US005878724A

United States Patent [19]

Channing

[11] Patent Number: 5,878,724

[45] Date of Patent: Mar. 9, 1999

[54] DIESEL VEHICLE PRIMARY FUEL PUMP DRIVEN BY RETURN FUEL ENERGY

[75] Inventor: Derek Albert Channing, Livonia, Mich.

[73] Assignee: Ford Global Technologies, Inc., Dearborn, Mich.

[21] Appl. No.: 996,901

[22] Filed: Dec. 23, 1997

[51] Int. Cl.[6] ..... F02M 37/04

[52] U.S. Cl. ..... 123/514; 417/406

[58] Field of Search ..... 123/514; 417/406, 417/407

[56] References Cited

U.S. PATENT DOCUMENTS

| | | | |
|---|---|---|---|
| 3,695,097 | 10/1972 | Michalowicz . | |
| 4,454,851 | 6/1984 | Bourbonnaud et al. . | |
| 4,501,251 | 2/1985 | Kelch . | |
| 4,569,640 | 2/1986 | Zimmern | 417/406 |
| 4,838,307 | 6/1989 | Sasaki et al. | 123/514 |
| 5,072,706 | 12/1991 | Eblen et al. . | |
| 5,218,944 | 6/1993 | Leonard . | |
| 5,263,456 | 11/1993 | Owen-Evans . | |
| 5,396,872 | 3/1995 | Ruger et al. | 123/514 |

*Primary Examiner*—Thomas N. Moulis
*Attorney, Agent, or Firm*—Jerome R. Drouillard

[57] ABSTRACT

A fuel system for an automotive vehicle equipped with a diesel engine includes a fuel tank, a fuel injection pump, a fuel supply passage for conducting fuel from the fuel tank to the fuel injection pump, and a fuel return passage for conducting fuel from the fuel injection pump to the fuel tank. A hydraulically powered lift pump moves fuel from the fuel tank to the fuel injection pump through a fuel supply passage. The lift pump includes a hydraulic motor powered by fuel flowing through the fuel return passage and a primary fuel pump coupled to and powered by the hydraulic motor, with the primary fuel pump providing fuel to the injection pump through the fuel supply passage.

16 Claims, 3 Drawing Sheets

DIESEL VEHICLE PRIMARY FUEL PUMP DRIVEN BY RETURN FUEL ENERGY

FIELD OF THE INVENTION

The present invention relates to the use of energy available in fuel returning to a storage tank from a diesel fuel injection pump to hydraulically drive a primary fuel feed pump located either inside the fuel tank or at another location within a vehicle fuel system.

BACKGROUND OF THE INVENTION

Many modern light trucks and passenger cars with diesel engines use high pressure distributor pumps for fuel injection. Such distributor pumps always include a transfer pump, frequently a vane pump, situated within the injection pump housing. The purpose of the transfer pump is to increase the fuel supply pressure to a level where it will adequately fill the distributor system, as well as operating other features of the injection pump, such as the timing control system. The transfer pump has a closed loop pressure regulating system that provides pressure as a function of rotational speed. The pressure typically ranges from 200 kPa at lower engine speeds to 850 kPa at higher engine speeds.

The transfer pump mounted within the fuel injection pump is frequently used to pull fuel from the fuel tank. Such a prior art system is shown in FIG. 9, in which fuel injection pump 80 has transfer pump 81 incorporated therein. Fuel drawn from tank 94 by pump 81 passes through supply line 98 and filter 92 before reaching pump 81. Because the fuel lines and components extending from fuel tank 94 to fuel injection pump 80 are at negative pressure, this is generally known as a "depression fuel system". Depression fuel systems are prone to problems caused by the negative pressure, which can cause air ingress through minor leaks, resulting in unstable fuel injection and even failure of the engine to start. For this reason, more reliable vehicles with diesel engines have also included a primary or lift pump, to cause the fuel system to always operate at a positive pressure, preventing air ingress. If air or vapor does get into the fuel line between the fuel tank and the primary pump, a continuous bleed located in the pressurized part of the system will send the vapor and air back to the fuel tank.

Primary pumps used with diesel injection systems typically comprise a camshaft driven, self-regulating, reciprocating diaphragm type pump. However, on newer diesel engines with one or more overhead camshafts, the diaphragm pump becomes difficult to package. Also, the diaphragm fuel pump may not have adequate fuel flow for cooling modern high pressure distributor pump with electronic controls and spill type metering systems. Although diaphragm pumps are being replaced with electrically driven primary pump systems, this arrangement is not entirely satisfactory because electric pumps are expensive and require a separate dedicated pressure regulator. And, electric lift pumps suffer from a drawback inasmuch as they operate at essentially a constant volume which must be sized so as to exceed engine requirements at low speeds, while providing marginal fueling at higher speeds.

The present invention provides a reliable, low cost primary fuel pump. This pump can be used at minor added cost to change depression fuel systems to pressurized fuel systems, improving the reliability. The present low cost pump can also be used to replace electrically driven pumps in pressurized fuel systems, reducing the system cost.

SUMMARY OF THE INVENTION

According to the present invention, a fuel system for an automotive vehicle equipped with a diesel engine includes a fuel tank, a fuel injection pump, a fuel supply passage for conducting fuel from the fuel tank to the fuel injection pump, and a fuel return passage for conducting fuel from the fuel injection pump to the fuel tank. A hydraulically powered pump, also called a primary or lift pump, moves fuel from the fuel tank to the fuel injection pump through a fuel supply passage. The lift pump comprises a hydraulic motor powered by fuel flowing through the fuel return passage, and a primary fuel pump coupled to and powered by the hydraulic motor, with the primary fuel pump providing fuel to the fuel supply passage.

The present invention advantageously improves the reliability of diesel powered vehicles with depression fuel systems, by adding a low cost, easy to package, primary fuel pump.

A further advantage of the present invention is that replacing an electric primary pump with the inventive system will reduce cost, ease packaging, simplify electrical system requirements, improve reliability, and reduce noise.

DETAILED DESCRIPTION OF PREFERRED EMBODIMENTS

The proposed primary fuel pump may be packaged in several places in a vehicle fuel system. These include inside the fuel tank, or fuel tank delivery module, between the fuel tank and fuel filter, inside the fuel filter system, or part of the fuel filter head. The present pump may also be located between the fuel filter and fuel injection pump.

The present invention takes advantage of the return fuel's energy. The energy in the return fuel is provided by the distributor fuel injection system transfer pump. The return fuel flow volume varies with rotational speed, but is always 75 to 100% of the supply flow. The diesel injection distributor pump typically has a maximum return flow pressure limit of 100 kPa. The requirement for supply fuel is to be 100 to 133% of the return flow, with a minimum pressure requirement of slightly positive at the fuel injection pump inlet. Assuming a pressure drop across the fuel filter of 20 kPa maximum, the inventive pump may be operated at very low efficiency and still meet the requirements of most automotive diesel fuel systems. Special considerations may be required when selecting the type of hydraulic motor used. The return fuel flow rate varies as a function of rotational speed, with the maximum flow at high speed being a factor of five or more times the flow rate at low speed.

The inventive system includes a return fuel driven hydraulic motor driving a primary fuel pump. This can be achieved by many configurations, including the following examples. A first configuration includes a fixed displacement hydraulic motor (gear, gerotor, vane or other), directly driving a larger displacement fixed displacement fuel pump. A bypass loop around the pump, with a check valve, is required for starting. A second configuration includes a fixed displacement hydraulic motor, driving a same displacement hydraulic fuel pump, with step up gearing, with a ratio proportional to the maximum supply/return fuel flow ratio, divided by overall pump, motor and gearset minimum efficiency. A bypass loop around the pump, with a check valve, is required for starting. According to a third configuration, a fixed displacement hydraulic motor, drives a turbine pump, through step up gearing, which may be of the planetary or other configurations.

Other possible configurations according to the present invention include a turbine motor, possibly with variable nozzle vanes, driving a turbine pump, or a variable displacement hydraulic motor driving a primary fuel pump. A variable orifice and/or variable flow jet pump can be used to pressurize an in-tank closed (orifice vented) fuel delivery module.

Figure 1:
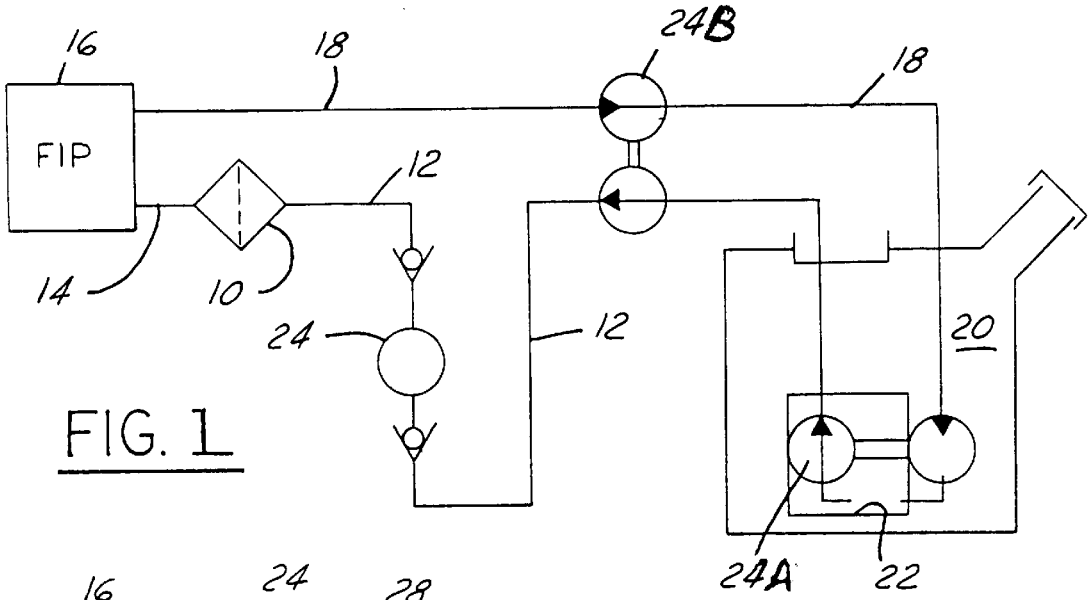
FIG. 1 is a schematic representation of a diesel fuel system, with a two port filter, showing alternative locations for a lift pump according to the present invention.

The diesel vehicle fuel system shown in FIG. 1 has two port filter 10 and unfiltered fuel supply passage 12, filtered fuel supply passage 14, and injection pump return fuel passage 18. FIG. 1 also shows hand primer system 24 and fuel injection pump 16. With this fuel system, a preferred location for hydraulically driven lift pump 24A according to the present invention is inside fuel tank 20, and specifically within fuel tank delivery module 22 if one is used. Other fuel circuit locations of the inventive pump are acceptable and may have advantages for a specific diesel powered vehicle. For example, lift pump 24B may be situated within return line 18 and unfiltered fuel supply passage 12.

Figure 2:
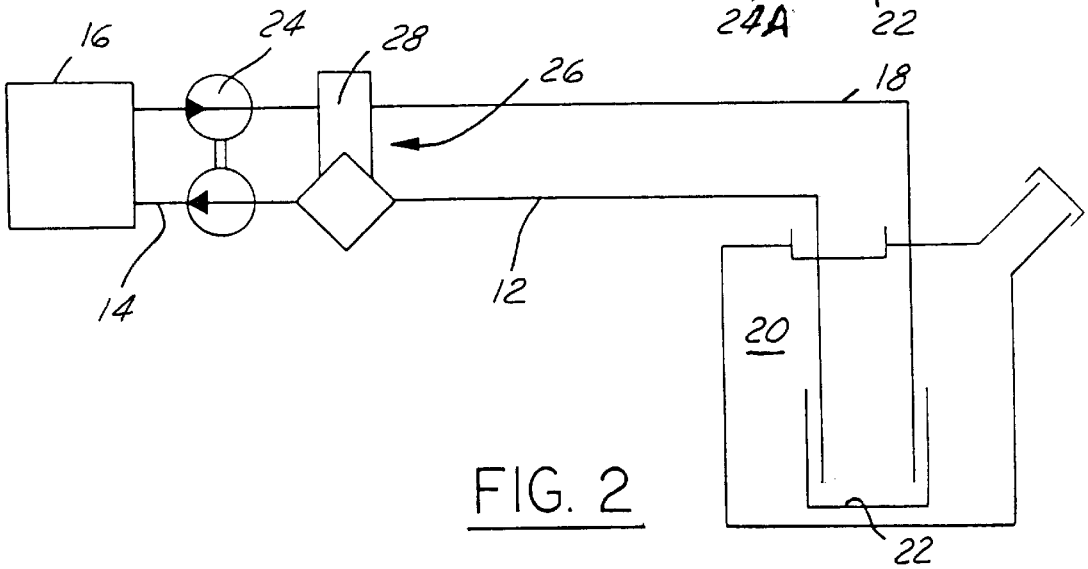
FIG. 2 is a schematic representation of a diesel fuel system with a four port filter, a return fuel temperature diverter system, and a distributor type fuel injection pump, showing several alternative locations for a lift pump according to the present invention.

The diesel vehicle fuel system shown in FIG. 2 has four port filter 26, which includes temperature sensitive diverter system 28. Diverter system 28 splits the injection pump return fuel flow passage into two sections, from injection pump 16 to diverter 28 and from diverter 28 to fuel tank 20. For the fuel system of FIG. 2, hydraulically driven lift pump 24 may be placed inside fuel tank 20, or in fuel tank delivery module 22, if one is used. However, when the fuel is cold and diverter system 28 is in a filter recirculation mode, there could be insufficient flow back to fuel tank 20 to drive pump 24. To overcome this, lift pump 24 is preferably placed close to fuel filter 26 such that, as shown in FIG. 2, the primary fuel pump element of the lift pump operates with fuel flowing through filtered fuel supply passage 14.

Figure 3:
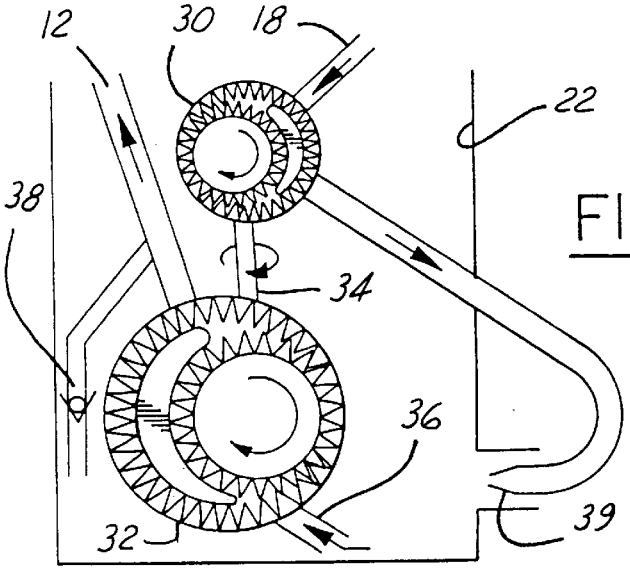
FIG. 3 is a schematic representation of an embodiment of the present invention which uses a fixed displacement hydraulic motor, directly driving a larger displacement fixed displacement primary fuel pump.

As shown in FIG. 3, the present lift pump preferably comprises hydraulic motor 30, driven by injection pump return fuel flow from return passage 18, and primary fuel pump 32, which delivers fuel to passage 12. Driveshaft 34 between motor 30 and pump 32 provides a mechanical connection between the motor and pump. Hydraulic motor 30 and fuel pump 32 have fixed displacements, and may be of the illustrated gerotor, or vane, or gear, or other type of hydraulic motor or pump known to those skilled in the art and suggested by this disclosure. Primary fuel pump 32 has a larger displacement than hydraulic motor 30, according to the proportion of the maximum fuel supply flow versus the maximum return fuel flow ratio, divided by the minimum efficiency of the system. Check valve 38 is used as a bypass to primary fuel pump 32, which is required to get the system started. Jet pump 39 serves to entrain additional fuel into delivery module 22.

Figure 4:
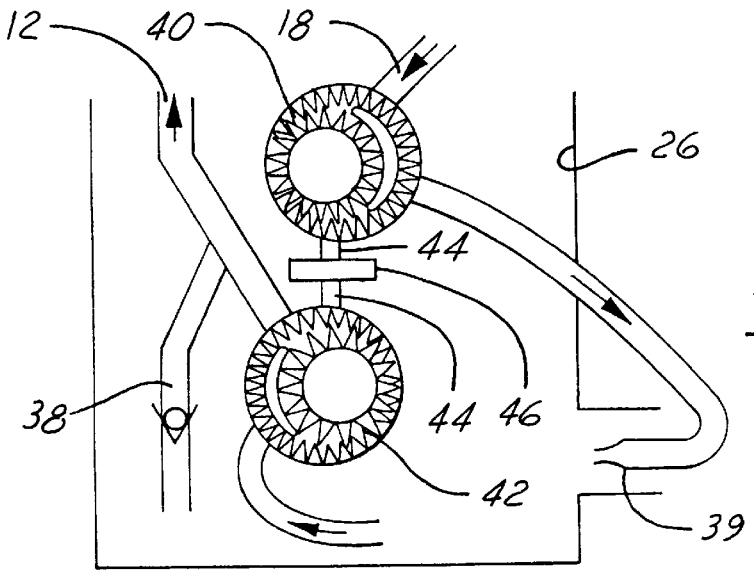
FIG. 4 is a schematic representation of an embodiment of the present invention, using a fixed displacement hydraulic motor, driving an identical fixed displacement unit as a primary fuel pump, through step up gearing.

FIG. 4 illustrates fixed displacement hydraulic motor 40 and fixed displacement primary fuel pump 42. As with the embodiment of FIG. 3, motor 40 can be of the illustrated gerotor, or vane, or gear or other type known to those skilled in the art and suggested by this disclosure. Motor 40 drives fixed displacement primary fuel pump 42 by driveshaft 44 and gearset 46. Fuel pump 42 may be identical in manufacture, mechanical layout and displacement to hydraulic motor 40. This provides cost savings inasmuch as only one set of tooling is needed to manufacture both the pump and the motor. The drive ratio of gearset 46 is in the proportion of the maximum fuel supply flow versus the maximum return fuel flow ratio, divided by the minimum efficiency of the system.

Figure 5:
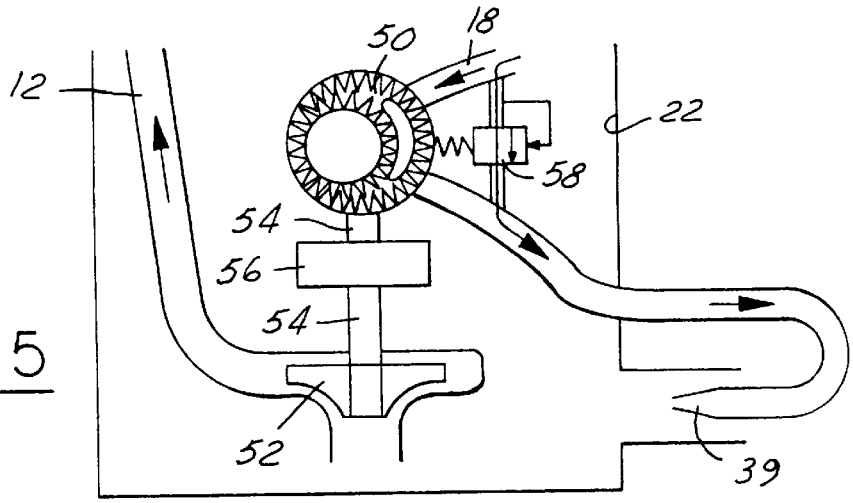
FIG. 5 is a schematic representation of an embodiment of the present invention using a fixed displacement hydraulic motor, driving a centrifugal turbine pump, through step up gearing.

FIG. 5 illustrates pressure compensated, fixed displacement hydraulic motor 50 which drives centrifugal turbine fuel pump 54 by means of driveshaft 54 and speed increasing gearset 56. Bypass 58 is used to limit the pressure of return fuel through line 18. In turn, this limits the output pressure of pump 52.

Figure 6:
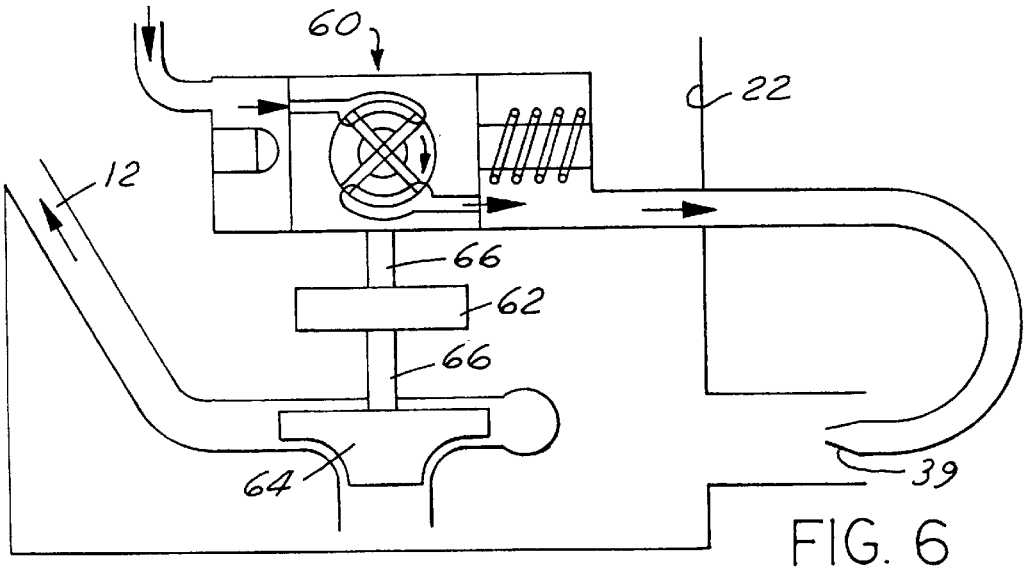
FIG. 6 is a schematic representation of an embodiment of the present invention using a variable displacement vane motor directly driving a turbine pump.

FIG. 6 shows variable displacement vane motor 60 directly driving turbine fuel pump 64 by driveshaft 66 and gearbox 62.

Figure 7:
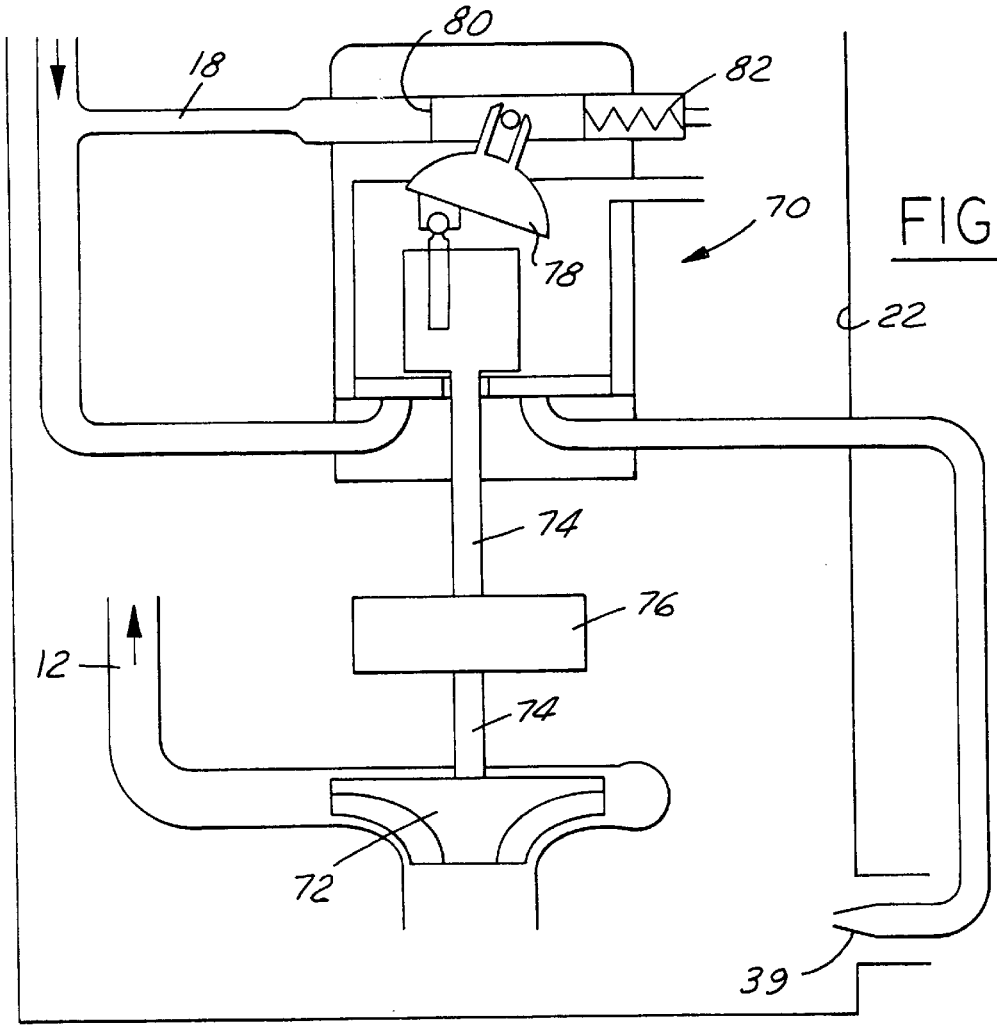
FIG. 7 is a schematic representation of an embodiment of the present invention using a variable displacement pressure controlled hydraulic motor to directly drive a turbine pump.
Figure 8:
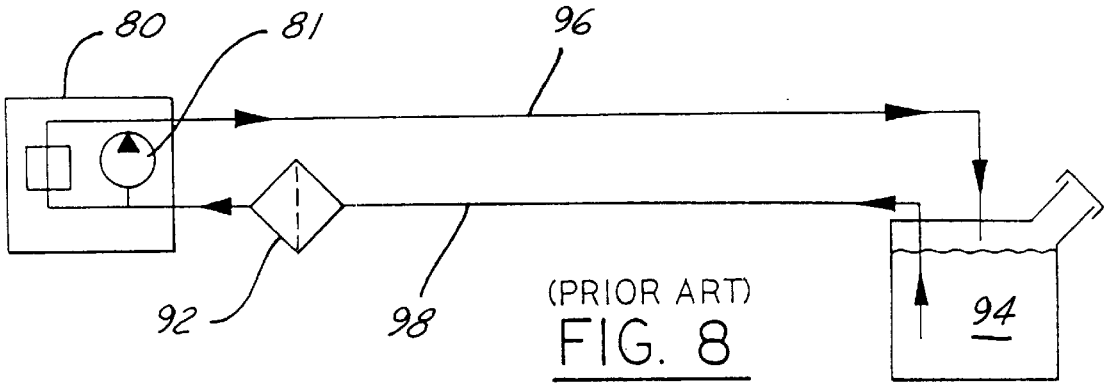
(PRIOR ART) FIG. 8
FIG. 8 is a schematic representation of a prior art depression diesel fuel delivery system.

FIG. 7 shows a pressure compensated variable displacement hydraulic motor 70, which is of the axial piston variety, driving turbine pump 72 by means of driveshaft 74 and speed increasing gearset 76. Hydraulic motor 70 has variable swashplate 78, which is positioned by piston 80, which acts in response to inputs from biasing spring 82 and the force of return fuel pressure acting within return line 18.

With each of the embodiments illustrated in FIGS. 3 to 7, the exhausted fuel from the hydraulic motor may be employed to drive jet pump 39. If desired, the exhaust may be sent to a temperature sensitive diverter valve (not shown) that selectively directs the fuel to the inside or outside of module 22.

While the invention has been shown and described in its preferred embodiments, it will be clear to those skilled in the arts to which it pertains that many changes and modifications may be made thereto without departing from the scope of the invention.

I claim:

1. A fuel system for an automotive vehicle equipped with a diesel engine, comprising:

a fuel tank;

a fuel injection pump;

a fuel supply passage for conducting fuel from the fuel tank to the fuel injection pump;

a fuel return passage for conducting fuel from the fuel injection pump to the fuel tank; and a hydraulically powered lift pump for moving fuel from the fuel tank to the fuel injection pump through the fuel supply passage, with said lift pump comprising;

a hydraulic motor powered by fuel flowing through the fuel return passage; and a primary fuel pump coupled to and powered by said hydraulic motor, with said primary fuel pump providing fuel to said fuel supply passage.

2. A fuel system according to claim 1, wherein said fuel injection pump comprises a distributor pump.

3. A fuel system according to claim 1, wherein said hydraulic motor comprises a gerotor motor.

4. A fuel system according to claim 1, wherein said hydraulic motor comprises a vane motor.

5. A fuel system according to claim 1, wherein said hydraulic motor comprises an axial piston motor.

6. A fuel system according to claim 5, wherein said axial piston motor comprises a variable displacement motor having a pressure operated swashplate to vary the displacement.

7. A fuel system according to claim 1, wherein said primary fuel pump comprises a gerotor pump.

8. A fuel system according to claim 1, wherein said primary fuel pump comprises a turbine pump.

9. A fuel system according to claim 1, wherein said lift pump is mounted within said fuel tank.

10. A fuel system according to claim 1, wherein said lift pump is mounted within a fuel delivery module mounted with said fuel tank.

11. A fuel system according to claim 1, wherein said lift pump is mounted externally of said fuel tank such that the hydraulic motor receives fuel from the fuel return passage and said pump receives fuel from the supply passage.

12. A fuel system for an automotive vehicle equipped with a diesel engine, comprising:

a fuel tank;

a fuel injection pump;

a fuel supply passage for conducting fuel from the fuel tank to the fuel injection pump;

a fuel return passage for conducting fuel from the fuel injection pump to the fuel tank;

a fuel filter having a filter element for cleaning fuel flowing within the fuel supply passage and a diverter valve for diverting to the fuel supply passage at least a fraction of the fuel flowing from the fuel injection pump through the fuel return passage; and a hydraulically powered lift pump for moving fuel from the fuel tank to the fuel injection pump through the fuel supply passage, with said lift pump comprising a hydraulic motor powered by fuel flowing through the fuel return passage between the fuel injection pump and the diverter valve and a primary fuel pump coupled to and powered by said hydraulic motor, with said primary fuel pump connected to the fuel supply passage between the fuel filter and the fuel injection pump such that fuel is picked up from the fuel tank, drawn through the filter element, and furnished to the fuel injection pump.

13. A fuel system according to claim 12, wherein the hydraulic motor is coupled to the primary fuel pump by a drive shaft having a gear train interposed therein.

14. A fuel system according to claim 13, wherein said gear train causes the primary fuel pump to be driven at a speed which is slower than the speed of said motor.

15. A fuel system according to claim 13, wherein said gear train causes the primary fuel pump to be driven at a speed which is faster than the speed of said motor.

16. A fuel system according to claim 12, wherein fuel exhausted from said motor drives a jet pump so as to fill a fuel delivery module located within the fuel tank.

* * * * *